US008872502B2

(12) United States Patent
Mengad

(10) Patent No.: US 8,872,502 B2
(45) Date of Patent: Oct. 28, 2014

(54) VOLTAGE REGULATOR WITH LOW AND HIGH POWER MODES

(75) Inventor: Zakaria Mengad, Toulouse (FR)

(73) Assignee: Freescale Semiconductor, Inc., Austin, TX (US)

( * ) Notice: Subject to any disclaimer, the term of this patent is extended or adjusted under 35 U.S.C. 154(b) by 551 days.

(21) Appl. No.: 13/058,350

(22) PCT Filed: Aug. 22, 2008

(86) PCT No.: PCT/IB2008/054476

§ 371 (c)(1),
(2), (4) Date: Feb. 10, 2011

(87) PCT Pub. No.: WO2010/020837

PCT Pub. Date: Feb. 25, 2010

(65) Prior Publication Data

US 2011/0133709 A1 Jun. 9, 2011

(51) Int. Cl.
*G05F 3/04* (2006.01)
*G05F 1/56* (2006.01)

(52) U.S. Cl.
CPC ..... *G05F 1/56* (2013.01)
USPC ..... 323/312

(58) Field of Classification Search
USPC ..... 323/268–269, 271–274, 304, 311, 312, 323/313, 314
See application file for complete search history.

(56) References Cited

U.S. PATENT DOCUMENTS

| | | | | |
|---|---|---|---|---|
| 5,471,130 | A * | 11/1995 | Agiman | 323/303 |
| 6,236,194 | B1 | 5/2001 | Manabe et al. | |
| 6,965,502 | B2 * | 11/2005 | Duffy et al. | 361/18 |
| 7,190,189 | B2 * | 3/2007 | Luo | 326/31 |
| 7,327,125 | B2 * | 2/2008 | Benbrik | 323/269 |
| 7,352,210 | B2 * | 4/2008 | Luo | 326/82 |
| 7,589,563 | B2 * | 9/2009 | Luo | 326/82 |
| 2003/0178976 | A1 | 9/2003 | Xi | |
| 2004/0000896 | A1 | 1/2004 | Barber et al. | |
| 2005/0189932 | A1 | 9/2005 | Itoh | |
| 2006/0044853 | A1 * | 3/2006 | Oswald et al. | 363/72 |
| 2006/0250119 | A1 | 11/2006 | Ostrom et al. | |

OTHER PUBLICATIONS

International Search Report and Written Opinion correlating to PCT/IB2008/054476 dated May 27, 2009.

* cited by examiner

*Primary Examiner* — Adolf Berhane
*Assistant Examiner* — Henry Lee, III

(57) ABSTRACT

A voltage regulator including first and second regulator elements connected between an output node and a supply rail for supplying load current to a load connected to the output node. The voltage regulator includes first and second control modules for controlling the first and second regulator elements respectively to maintain the output node at a regulated voltage in the presence of a variable impedance presented by the load to the output node, the second regulator element and the second control module having a smaller load current capacity and smaller leakage current than the first regulator element and the first control module. The voltage regulator includes a mode selector for de-activating the first regulator element and the first control module in a first operational mode, for activating the first regulator element and the first control module in a second operational mode.

20 Claims, 4 Drawing Sheets

*-PRIOR ART-*

*-PRIOR ART-*

VOLTAGE REGULATOR WITH LOW AND HIGH POWER MODES

FIELD OF THE INVENTION

This invention relates to a voltage regulator with low and high power modes.

BACKGROUND OF THE INVENTION

Battery-operated devices, such as mobile telephones and other hand-held devices, include increasing numbers of voltage regulators for supplying power to different functions such as radio frequency transceivers, base band circuits, audio circuits, liquid crystal displays, multi-media cards, Bluetooth communication circuits, universal serial bus ('USB') circuits, and vibrators for example. Each voltage regulator passes a quiescent current and the multiplication of voltage regulators multiplies the overall wastage of battery power due to the quiescent currents, reducing battery autonomy between recharging operations.

FIG. 1 of the accompanying drawings shows a voltage regulator 100 connected between a supply rail 102 and ground 104, between which a battery 106 is connected to supply power. the voltage regulator 100 provides a regulated output voltage Vout at an output node 108 to which a load 110 can be connected to receive a supply current i_load. The quiescent current icq of the regulator flows in parallel with the load current i_load and the battery 106 is drained by the sum of the currents i_load+icq. The quiescent current has a larger impact in proportion during low power or standby operation, when the load current i_load is small, which often lasts for longer periods than high power operation.

It is possible to include additional circuits in the regulator to reduce quiescent current automatically during low power or standby operation without reducing the performance of the high power operation. FIG. 2 of the accompanying drawings shows a multimode voltage regulator 200 comprising a high power voltage regulator module 202, a low power voltage regulator module 204 and a multimode control module 206 for causing either the high power voltage regulator module 202 or the low power voltage regulator module 204 to supply the load. In a variant of this circuit, during operation in the high power mode, both the high power voltage regulator module 202 and the low power voltage regulator module 204 supply the load.

US patent specification 2003/0178976 discloses a multimode voltage regulator in which a control module varies biasing for a low power voltage regulator module and a high power voltage regulator module to control the operational mode between a normal operation mode and a SLEEP mode.

SUMMARY OF THE INVENTION

The present invention provides a voltage regulator as described in the accompanying claims.

These and other aspects of the invention will be apparent from and elucidated with reference to the embodiments described hereinafter.

BRIEF DESCRIPTION OF THE DRAWINGS

Further details, aspects and embodiments of the invention will be described, by way of example only, with reference to the drawings. Elements in the figures are illustrated for simplicity and clarity and have not necessarily been drawn to scale.

DETAILED DESCRIPTION OF THE PREFERRED EMBODIMENTS

Figure 1:
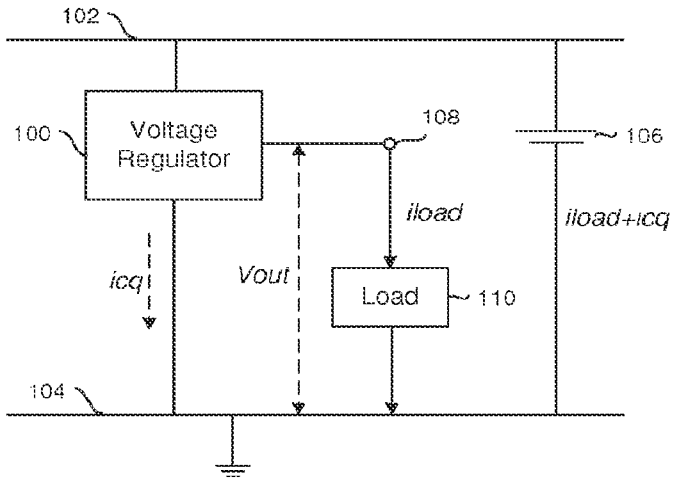
FIG. 1 is a schematic diagram of the overall structure of a voltage regulator illustrating load and quiescent currents that are generated.
Figure 2:
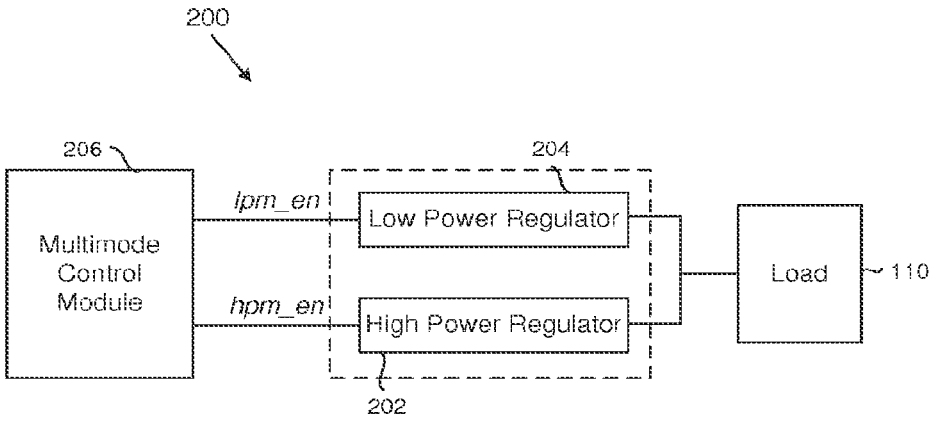
FIG. 2 is a schematic diagram of a multimode voltage regulator.
Figure 3:
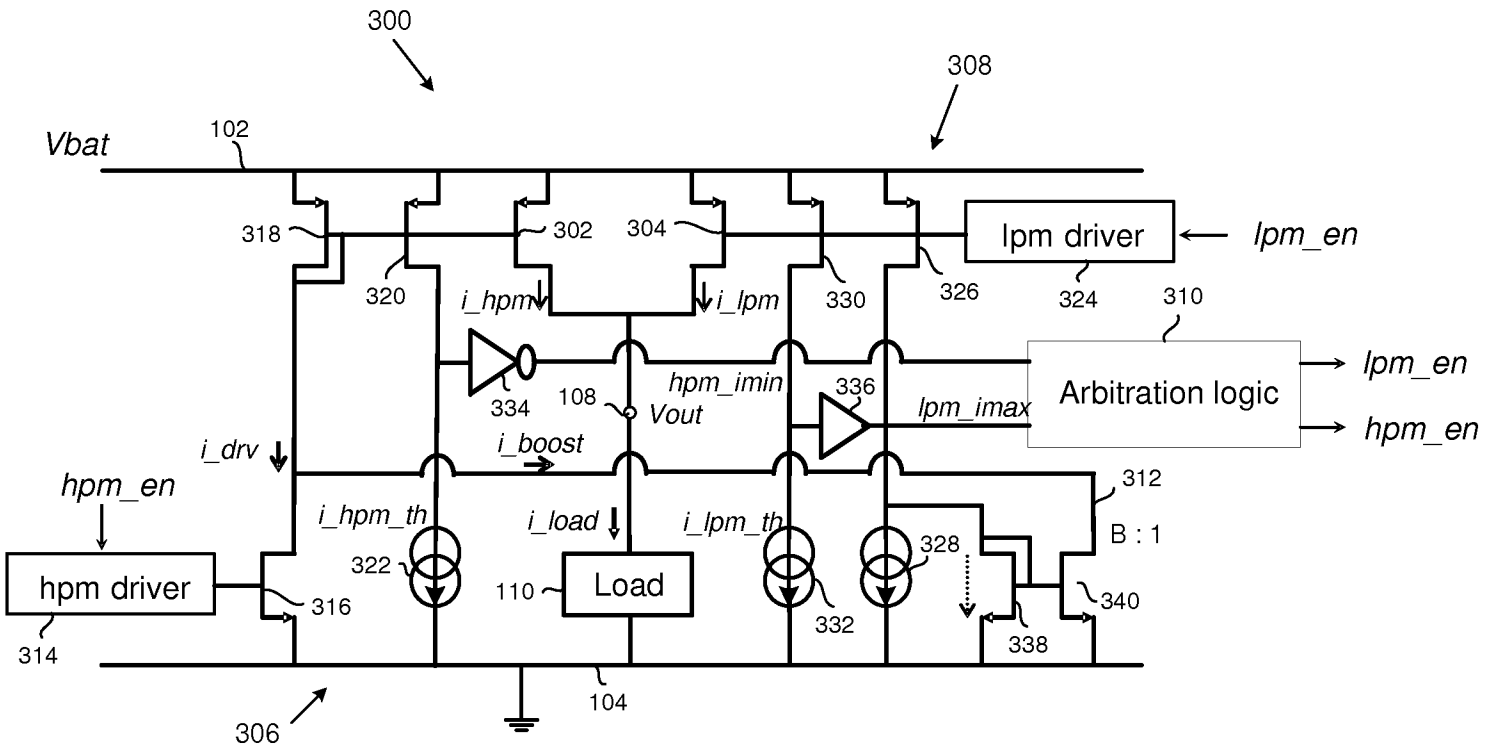
FIG. 3 is a schematic diagram of a multimode voltage regulator in accordance with one embodiment of the invention, given by way of example.

FIG. 3 shows a multimode voltage regulator 300 in accordance with an example of an embodiment of the present invention having two operational modes a low power and a high power mode. The voltage regulator 300 comprises first and second regulator elements 302 and 304, comprising respective field-effect transistors ('FET'), the sources of the FETs 302 and 304 being connected to the supply rail 102 and their drains being connected to the output node 108 for supplying load current i_load to a load 110 connected to the output node. The voltage regulator 300 also comprises first and second control modules 306 and 308 for controlling the first and second regulator elements 302 and 304 respectively, so as to maintain the output node 108 at a regulated voltage Vout in the presence of variable impedance presented by the load 110 to the output node 108. The second regulator element 304 and the second control module 308 have a smaller load current capacity and smaller leakage current than the first regulator element 302 and the first control module 306. The voltage regulator 300 also comprises a mode selector including an arbitration logic processor 310 for deactivating the first, high power regulator element 302 and control module 306 in a first, low power operational mode in response to a load current i_load less than a threshold value i_hpm_th, and for activating the first, high power regulator element 302 and control module 306 in a second, high power operational mode in response to a load current i_load greater than a threshold value i_lpm_th, The voltage regulator 300 also comprises an additional current-carrying path 312 for the first control module 306 for carrying supplementary current for the first control module 306 at least during a transition from the first, low power operational mode to the second, high power operational mode.

The first, high power control module 306 comprises a high power mode driver 314 connected to the gate of an amplifier FET 316 whose source is connected to ground 104 and whose drain is connected to the drain of an FET 318, the source of the FET 318 being connected to the supply rail 102 and its drain being connected to its gate. The gate of the FET 318 is connected to the gate of the regulator FET 302.

In steady-state operation, when activated, the driver 314 controls the FET 316 to pass a current i_drv flowing also through the FET 318 and maintaining the gate of the regulator FET 302 at a voltage such as to regulate the output voltage Vout in spite of changes in the load impedance.

The gate of the FET 318 is also connected to the gate of a replicator FET 320, whose source is connected to the supply rail 102 and whose drain is connected through a constant current source 322 to ground. The replicator FET 320 presents an impedance equivalent to that presented by the regulator FET 302 during the high power operational mode but with a much smaller current carrying capacity and much smaller leakage current. When the impedance of the replicator FET 320 falls below a threshold value, corresponding to the regulator FET 302 conducting a current greater than a threshold defined by the constant current i_hpm_th of the source 322, the drain of the replicator FET 320 rises towards the voltage of the supply rail 102. When the regulator FET 302 conducts a current less than the threshold defined by the constant current i_hpm_th, the drain-source impedance of the replicator FET 320 increases and the source 322 pulls the drain of the FET 320 down towards ground 104.

The second control module 308 comprises a low power mode driver 324 connected directly to the gate of the regulator FET 304 and also to the gate of an FET 326 whose source is connected to the supply rail 102 and whose drain is connected through a constant current source 328 to ground.

In steady-state operation, when activated, the driver 324 maintains the gate of the regulator FET 304 at a voltage such as to regulate the output voltage Vout in spite of changes in the load impedance.

The gate of the regulator FET 304 is also connected to the gate of a replicator FET 330, whose source is connected to the supply rail 102 and whose drain is connected through a constant current source 332 to ground. When the regulator FET 304 conducts a current greater than a threshold defined by the constant current i_lpm_th that the source 332 can carry, the drain of the replicator FET 330 rises towards the voltage of the supply rail 102. When the regulator FET 304 conducts a current less than the threshold defined by the constant current i_lpm_th, the drain-source impedance of the replicator FET 330 increases and the constant current source 332 pulls the drain of the FET 330 down towards ground 104.

The drain of the replicator FET 330 is connected through a non-inverting buffer amplifier 336 to another input of the arbitration logic processor 310 to assert a signal lpm_imax when the voltage of the drain of the replicator FET 330 is high and the output of the buffer amplifier 334 is high, corresponding to load current in the second, low power regulator FET 302 greater than a first threshold. The arbitration logic processor 310 then asserts a signal hpm_en on one output which is connected to the high power driver 314 to activate the first, high power FET 302. The operational mode of the voltage regulator 300 then passes from the low power operational mode to the high power operational mode, the high power driver 314 applying a voltage to the gate of the FET 316 to make the FETs 318 and 302 conduct, the drain of the FET 318 establishing with the FET 316 a voltage defined by the driver 314 to regulate the current in the regulator FET 302 and hence the output voltage Vout at the output node 108.

It is possible to use the same threshold defined by the de-assertion of the signal lpm_imax to de-assert the signal hpm_en for the high power driver 314 to de-activate the first, high power FET 302 when the load current it carries is lower than the corresponding threshold, provided suitable hysteresis is introduced to avoid instability.

However, in this embodiment of the invention, the arbitration logic processor 310 de-asserts the signal lpm_en, after turning on the regulator 304 to establish the high power operational mode, which turns off the second, low power regulator FET 304 during the high power operational mode and the signal lpm_imax is also de-asserted since the FET 330 is also turned off during the high power operational mode. This reduces quiescent current during the high power operational mode and prevents instability when the load current is close to the hpm_imin.

In this embodiment of the invention, the drain of the replicator FET 320 is connected through an inverting buffer amplifier 334 to one input of the arbitration logic processor 310 to assert a signal hpm_imin when the voltage of the drain of the replicator FET 320 is low and the output of the buffer amplifier 334 is high, corresponding to load current in the first, high power regulator FET 302 less than a second threshold, lower than the threshold corresponding to lpm_imax. The arbitration logic processor 310 then de-asserts the signal hpm_en on the output which is connected to the high power driver 314 to de-activate the first, high power FET 302 and simultaneously asserts the signal lpm_en on the output which is connected to the low power driver 324 to activate the second, low power FET 304.

A sudden connection of a low impedance load 110 to the node 108, or a sudden reduction in the impedance of a load 110 already connected to the node 108 can draw a large current that can reduce the output voltage Vout excessively. The ability of the first, high power control module 306 to switch on the first, high power FET 302 rapidly and use it to regulate the output voltage Vout quickly is constrained by the time constants of the control module 306, which are impacted by the capacitances of the FETs, notably of the gate of the first, high power FET 302. The additional current-carrying path 312 is connected to the drain of the FET 318 and comprises current mirror FETs 338 and 340. The drain of the FET 338 is connected to the drain of the FET 326 and its source is connected to ground. The source of the FET 340 is connected to ground and the drain of the FET 340 is connected by the additional current-carrying path 312 to the drain of the FET 318. The gates of the FETs 338 and 340 are connected to each other and to the drain of the FET 338.

The additional current-carrying path 312 carries a supplementary current i_boost for the first control module 306 at least during a transition from said first operational mode to said second operational mode. This supplementary current i_boost adds to the drive current i_drv in the direction to accelerate the transition from the first, low power operational mode to the second, high power operational mode. In more detail, activation of the additional current-carrying path 312 pulls down the voltage of the drain of the FET 318 and the gate of the regulator FET 302 faster than the drive current i_drv could alone in view of the delay caused by the capacitances, especially of the gate of the FET 302.

The mode selector, including the arbitration logic processor 310, is arranged to activate the additional current-carrying path 312 to carry the supplementary current i_boost for the first control module 306 in response to a load current i_load in the second, low power regulator FET 304 greater than the threshold value defined by lpm_imax. In more detail, before the arbitration logic processor 310 de-asserts the signal lpm_en, when the load current i_load in the second, low power regulator FET 304 exceeds the threshold value defined by lpm_imax, the current in the FET 326 exceeds the constant current taken by the source 328. The excess current flows in the FET 338, pulling up the voltage of the gates of the FETs 338 and 340, the FET 340 amplifying the supplementary current i_boost in the additional current-carrying path 312 relative to the current in the FET 338 with a multiplication ratio relative to the current in the FET 338 which can be chosen by choosing different sizes for the two FETs.

The mode selector 310 is arranged to de-activate the additional current-carrying path when the first regulator element 302 and the first control module 306 are activated in the second operational mode. In this example, the supplementary current i_boost in the additional current-carrying path 312 is arranged to last only temporarily, during a limited period of time from an initiation of the transition from the low power operational mode to the high power operational mode. When the load current i_load in the second, low power regulator FET 304 exceeds the threshold value defined by lpm_imax and causes the arbitration logic processor 310 subsequently to de-assert the signal lpm_en, the FET 326 turns off, like the FETs 304 and 330, and the current source 328 pulls down the gate voltages of the FETs 338 and 340, turning them off. Accordingly, the supplementary current i_boost from the additional current-carrying path 312 does not interfere with the voltage regulation function of the high power driver 314 and the drive current i_drv after the operation of the high power control module 306 is established. Accordingly, moreover, the supplementary current i_boost from the additional current-carrying path 312 only contributes temporarily to the overall quiescent current of the regulator during the transition from the low power operational mode to the high power operational mode.

It will be appreciated that the voltage regulator 300 shown in FIG. 3 does not need input from an external processor, such as the baseband processor of a mobile telephone for example, pre-selecting and pre-setting the high power regulator module 306 in preparation for a low impedance, high current consumption load. Such pre-selection would not always be available and would not always be accurate, even if available. Instead, the voltage regulator 300 replicates the output current, uses autonomous arbitration logic to select and implement the transitions from the low power operational mode to the high power operational mode and back and uses a supplementary current derived from the low power regulation module to accelerate the transition from the low power operational mode to the high power operational mode.

The constant current sources 322, 328 and 332 may be active constant current sources or may be large resistors.

Figure 4:
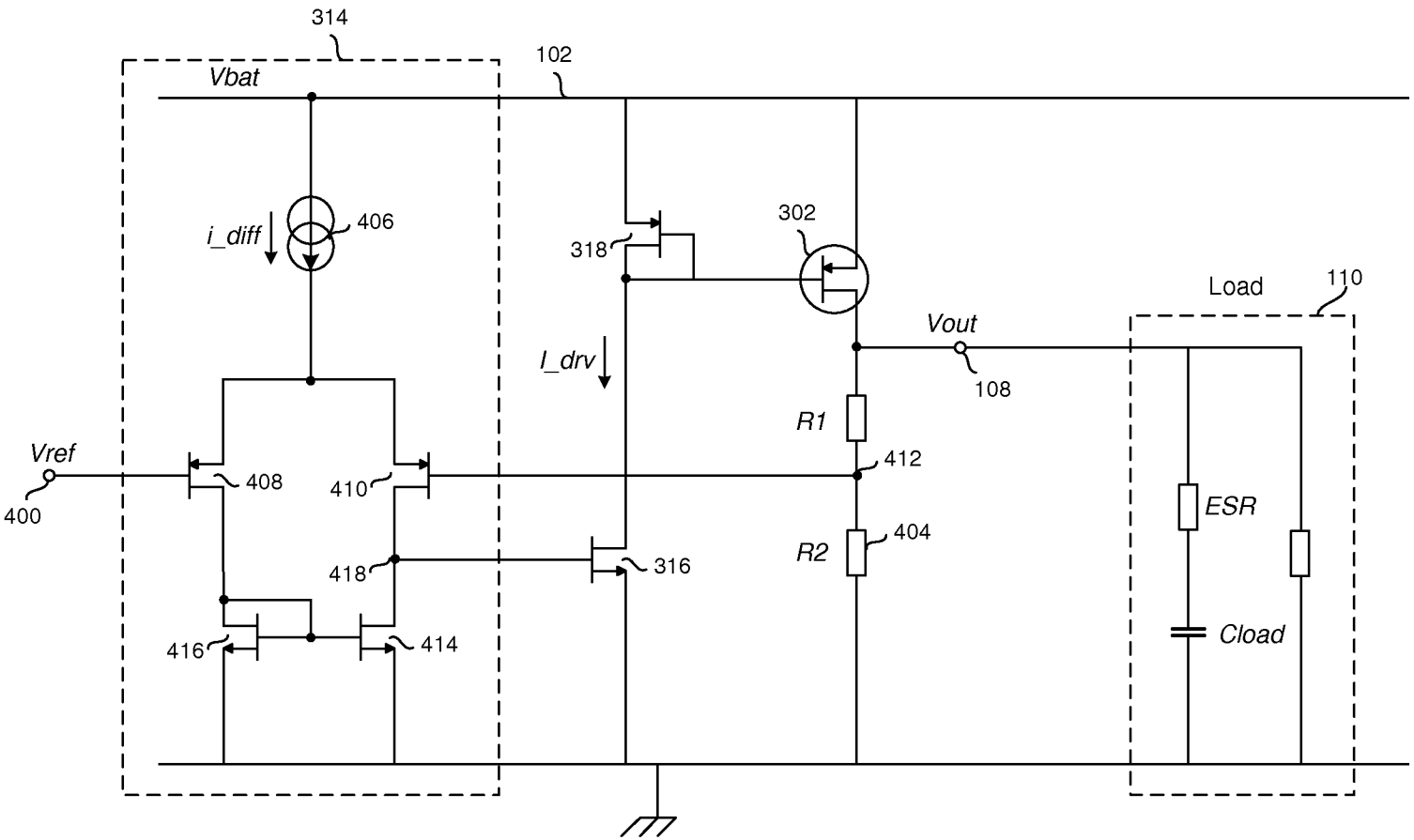
FIG. 4 is a schematic diagram of an example of a driver included in the voltage regulator of FIG. 3.

Various configurations can be used for the high and low power drivers 314 and 324. One implementation of a high power driver 314 is shown in FIG. 4 by way of example. A reference voltage for the driver is provided by an external source at a terminal 400, although the driver could be provided with an internal reference source. The reference voltage is compared with a voltage k*Vout proportional to the regulated output voltage Vout from a voltage divider comprising resistors 402 and 404 connected in series between the output node 108 and ground.

In more detail, the driver 314 comprises a constant current source 406 for passing a current i_diff and connected between the supply rail 102 and common source terminals of a differential pair of FETs 408 and 410. The gate of the FET 408 is connected to the reference voltage terminal 400 and the gate of the FET 410 is connected to a node 412 in the voltage divider between the resistors 402 and 404. The drain of the FET 410 is connected to the drain of an FET 414, whose source is connected to ground. The drain of the FET 408 is connected to the drain of an FET 416, whose source is connected to ground and whose gate is connected to the gate of the FET 414 and to the drain of the FET 416. A node 418 between the drains of the FETs 410 and 414 is connected to the gate of the FET 316. The activate/de-activate input hpm_en is applied to nmos/pmos switches (not shown in FIG. 4) which are connected between the gate and source of each device to force it to 0V when the regulator is de-activated.

In operation, the voltage at the node 418 establishes itself at a value equal to the difference (Vref−k*Vout) between the reference voltage at the terminal 400 and the divided output voltage at the node 412 plus a gate threshold voltage. This difference voltage applied to the gate of the FET 316 tends to correct deviation of the actual output voltage Vout from the regulated value set by the ratio Vref/k.

The low power driver 324 may be similar to that shown in FIG. 4. However, it is possible to use a simpler circuit, if the specification for voltage regulation in the low power operational mode is less stringent than that in the high power operational mode, for example.

Figure 5:
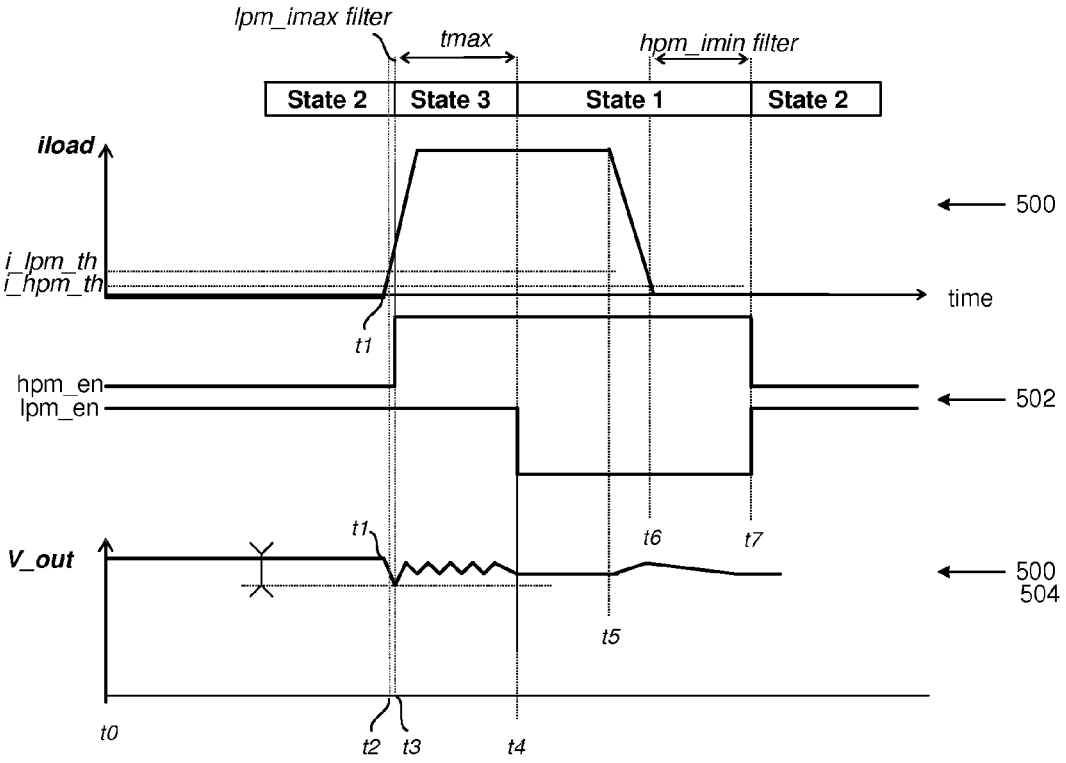
FIG. 5 is a graph of the variation with time of currents and voltages in an example of operation of the voltage regulator of FIG. 3.

FIG. 5 shows examples of the variations with time of signals in operation of the regulator of FIG. 3 in three states:—

State 1 corresponds to activation of the first, high power regulator element 302 and control module 306 and de-activation of the second, low power regulator element 304 and control module 308 (high power operational mode), State 2 corresponds to de-activation of the first, high power regulator element 302 and control module 306 and activation of the second, low power regulator element 304 and control module 308 (low power operational mode) and State 3 corresponds to initiation of activation of the first, high power regulator element 302 and control module 306 and activation of the additional current-carrying path 312 while the second, low power regulator element 304 and control module 308 are still activated (transition from low power operational mode to high power operational mode).

The graph 500 shows the variation of the current i_load flowing in the load and either in the high power regulator FET 302 or the low power regulator FET 304. The graph 502 shows the assertion and de-assertion of the signals hpm_en and lpm_en generated by the arbitration logic processor 310. The graph 504 shows corresponding variations in the output voltage Vout at the output node 108.

The example of operation shown in FIG. 5 starts at time t0, initially in state 2, the low power operational mode. At time t1, a sudden reduction in the impedance of the load 110 occurs, causing a progressive increase in load current consumption, due to capacitances in the load and regulator, and a sudden drop in the output voltage Vout at the output node 108, the low power regulator FET 304 and control module 308 having insufficient current capacity to absorb the increased load current. At time t2, the current in the replicator FET 330 tends to exceed the threshold value i_lpm_th defined by the current source 332 and triggers initiation of a transition to the high power operational mode (State 3) and the increased current in the FET 326 activates the additional current-carrying path 312 while the low power second regulator element 304 and the second control module 308 are still activated.

The arbitration logic processor 310 includes a filter lpm_imax filter for delaying its response from time t2 to a time t3 to reduce the frequency of false transitions from the low power operational mode to the high power operational mode due to noise. However, the consequences of such false transitions are limited if they are not too frequent, since they result in temporary activation of the high power regulator FET 302 and control module 306 with a corresponding temporary increase in quiescent current but maintain proper control of the output voltage, and the delay t2 to t3 can be kept short.

At time t3, the arbitration logic processor 310 generates the signal hpm_en to initiate the transition to activation of the high power first regulator element 302 and the first control module 306, State 3. Assisted by the supplementary current i_boost from the additional current-carrying path 312, the high power first regulator element 302 and the first control module 306 rapidly reverse the decline in output voltage Vout.

Due to parasitic and load capacitances in the system, the output voltage tends to hunt about its regulated value until the system stabilises.

At a time t4 defined by the arbitration logic processor 310, as a function of the specification and the application of the regulator, the arbitration logic processor 310 de-asserts the signal lpm_en, de-activating the low power second regulator element 304, the second control module 308 and the additional current-carrying path 312. The regulator enters State 1, in which the high power first regulator element 302 and the first control module 306 regulate the output voltage Vout alone.

The regulator remains in State 1 until, at a time t5, an increase in load impedance occurs, causing a progressive reduction in the load current i_load, due to capacitances in the load and regulator. When, at a time t6, the load current i_load becomes less than the threshold value i_hpm_th defined by the current source 322, the reduction of the current in the replicator FET 320 triggers initiation of a transition to the low power operational mode (State 2). The threshold value i_hpm_th is less than the threshold value i_lpm_th to introduce hysteresis into the transitions and avoid instability.

The arbitration logic processor 310 includes a filter hpm_imin filter for delaying its response from time t6 to a time t7 to reduce the frequency of false transitions from the high power operational mode to the low power operational mode due to noise. The consequences of such false transitions are more serious than from the low power operational mode to the high power operational mode, even if they are not frequent, since they result in de-activation of the high power regulator FET 302 and control module 306 with a corresponding risk of loss of control of the output voltage if the transition is in fact false, which is a more serious consequence than a temporary maintenance of increased quiescent current. Accordingly, the delay t6 to t7 is substantially longer than the delay t2 to t3.

At time t7, the arbitration logic processor 310 asserts the signal lpm_en to initiate the activation of the low power second regulator element 304 and the second control module 308 and simultaneously de-asserts the signal hpm_en to de-activate the high power first regulator element 302 and the first control module 306, State 2.

Figure 6:
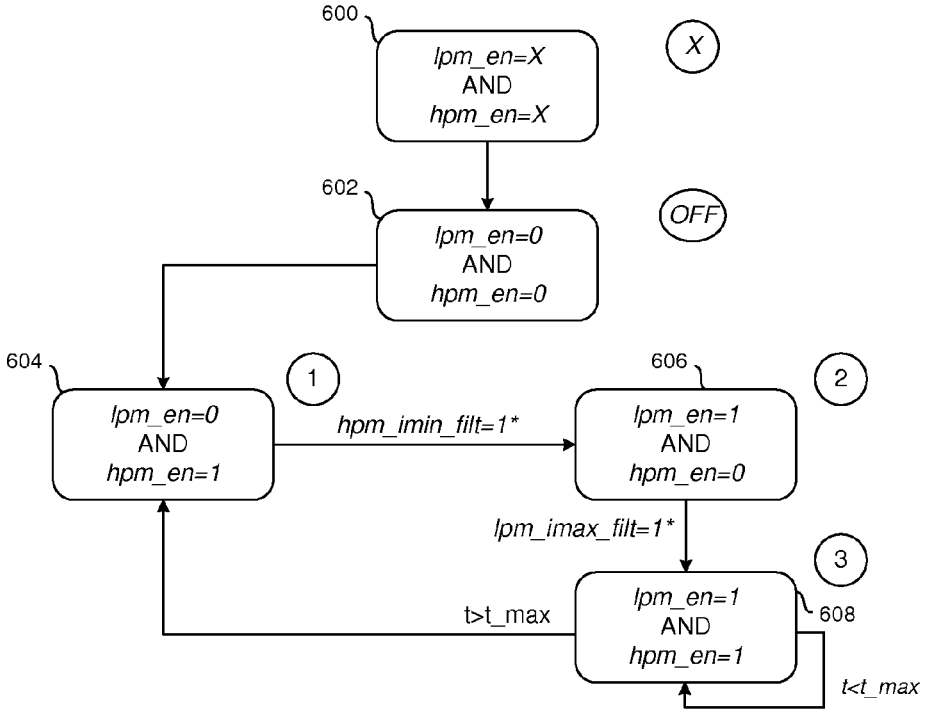
FIG. 6 is an example of a flow chart of control logic in a control module in the voltage regulator of FIG. 3.

FIG. 6 is a flow chart showing possible transitions between the States 1, 2 and 3 and other states. From any state X, as shown at 600, and whatever the values of the signals lpm_en and hpm_en, the arbitration logic processor 310 can de-assert both the signals lpm_en and hpm_en, turning the regulator 300 OFF, as shown at 602.

From the OFF state 602, the arbitration logic processor 310 can only assert the signal hpm_en, turning the regulator 300 ON directly in State 1 as at 604 with the high power first regulator element 302 and the first control module 306 activated and the signal lpm_en de-asserted. In this transition, no assistance is given to the first, high power control module 306 by the current-carrying path 312, and the low power second regulator element 304 and the second control module 308 are left de-activated, avoiding risk of instability.

From the State 1 as at 604, the regulator 300 can transition between the States 1, 2 as at 606 and 3 as at 608, as described above. The indications hpm_imin_filt*=1 and hpm_imin_filt*=1 signify that arbitration logic processor 310 only takes account of assertion of the signals for the corresponding transitions between states, not de-assertion.

In the foregoing specification, the invention has been described with reference to specific examples of embodiments of the invention. It will, however, be evident that various modifications and changes may be made therein without departing from the broader spirit and scope of the invention as set forth in the appended claims. For example, the connections may be any type of connection suitable to transfer signals from or to the respective nodes, units or devices, for example via intermediate devices. Accordingly, unless implied or stated otherwise the connections may for example be direct connections or indirect connections.

The methods of embodiments of the invention may be implemented partially or wholly in hardware or in a computer program including code portions for performing steps of the method when run on a programmable apparatus, such as a computer system, or enabling a programmable apparatus to perform functions of a device or system according to embodiments of the invention. The computer program may for instance include one or more of: a subroutine, a function, a procedure, an object method, an object implementation, an executable application, an applet, a servlet, a source code, an object code, a shared library/dynamic load library and/or other sequence of instructions designed for execution on a computer system. The computer program may be provided on a data carrier, such as a CD-ROM or other storage device, containing data loadable in a memory of a computer system, the data representing the computer program. The data carrier may further be a data connection, such as a telephone cable or a wireless connection. The description of the information processing architecture has been simplified for purposes of illustration, and it is just one of many different types of appropriate architectures that may be used in embodiments of the invention. It will be appreciated that the boundaries between logic blocks are merely illustrative and that alternative embodiments may merge logic blocks or circuit elements or impose an alternate decomposition of functionality upon various logic blocks or circuit elements.

As used herein, the terms "assert" or "set" and "negate" (or "de-assert" or "clear") are used herein when referring to the rendering of a signal, status bit, or similar apparatus into its logically true or logically false state, respectively. If the logically true state is a logic level one, the logically false state is a logic level zero. And if the logically true state is a logic level zero, the logically false state is a logic level one.

Where the apparatus implementing the present invention is composed of electronic components and circuits known to those skilled in the art, circuit details have not been explained to any greater extent than that considered necessary for the understanding and appreciation of the underlying concepts of the present invention.

Where the context admits, illustrated hardware elements may be circuitry located on a single integrated circuit or within a same device or may include a plurality of separate integrated circuits or separate devices interconnected with each other. Also, hardware elements in an embodiment of the invention may be replaced by software or code representations in an embodiment of the invention.

Furthermore, it will be appreciated that boundaries described and shown between the functionality of circuit elements and/or operations in an embodiment of the invention are merely illustrative. The functionality of multiple operations may be combined into a single operation, and/or the functionality of a single operation may be distributed in additional operations. Moreover, alternative embodiments may include multiple instances of a particular operation, and the order of operations may be altered in various other embodiments.

In the claims, any reference signs placed between parentheses shall not be construed as limiting the claim. Where the context admits, terms such as "first" and "second" are used to distinguish arbitrarily between the elements such terms describe and these terms are not necessarily intended to indicate temporal or other prioritization of such elements.

The invention claimed is:

1. A voltage regulator comprising:

first and second regulator elements connected between an output node and a supply rail for supplying load current to a load connected to said output node;

first and second control modules for controlling said first and second regulator elements respectively to maintain said output node at a regulated voltage in the presence of a variable impedance presented by said load to said output node, said second regulator element and said second control module having a smaller load current capacity and smaller leakage current than said first regulator element and said first control module;

a mode selector for de-activating said first regulator element and said first control module in a first operational mode in response to a load current less than a threshold value, and for activating said first regulator element and said first control module in a second operational mode in response to a load current greater than a threshold value; and an additional current-carrying path for carrying supplementary current for said first control module during a transition from said first operational mode to said second operational mode;

wherein said mode selector is arranged to de-activate said first regulator element and said first control module in a transition from said first operational mode to said second operational mode with a delay longer than a delay with which said mode selector is arranged to activate said first regulator element and said first control module in a transition from said second operational mode to said first operational mode.

2. A voltage regulator as claimed in claim 1, wherein said mode selector is arranged to activate said first regulator element and said first control module in response to load current in said second regulator element greater than a first threshold and to deactivate said first regulator element and said first control module in response to load current in said first regulator element less than a second threshold, said second threshold corresponding to load current less than said first threshold.

3. A voltage regulator as claimed in claim 1, wherein said mode selector is arranged to activate said additional current-carrying path to carry supplementary current for said first control module in response to a load current in said second regulator element greater than a threshold value.

4. A voltage regulator as claimed in claim 1, wherein said mode selector is arranged to activate said additional current-carrying path during a limited period of time from an initiation of said transition.

5. A voltage regulator as claimed in claim 1, wherein said mode selector is arranged to de-activate said additional current-carrying path when said first regulator element and said first control module are activated in said second operational mode.

6. A voltage regulator as claimed in claim 1, wherein said first and second regulator elements comprise respectively first and second transistor elements having first and second load current conduction paths connected between said output node and said supply rail and first and second control electrodes for controlling the impedance of said first and second load current conduction paths respectively, said additional current-carrying path being arranged to carry supplementary current for said first control electrode when activated, so as to accelerate said transition from said first operational mode to said second operational mode.

7. A voltage regulator as claimed in claim 2, wherein said mode selector is arranged to activate said additional current-carrying path to carry supplementary current for said first control module in response to a load current in said second regulator element greater than a threshold value.

8. A voltage regulator as claimed in claim 2, wherein said mode selector is arranged to activate said additional current-carrying path during a limited period of time from an initiation of said transition.

9. A voltage regulator as claimed in claim 3, wherein said mode selector is arranged to activate said additional current-carrying path during a limited period of time from an initiation of said transition.

10. A voltage regulator as claimed in claim 2, wherein said mode selector is arranged to de-activate said additional current-carrying path when said first regulator element and said first control module are activated in said second operational mode.

11. A voltage regulator as claimed in claim 3, wherein said mode selector is arranged to de-activate said additional current-carrying path when said first regulator element and said first control module are activated in said second operational mode.

12. A voltage regulator as claimed in claim 4, wherein said mode selector is arranged to de-activate said additional current-carrying path when said first regulator element and said first control module are activated in said second operational mode.

13. A voltage regulator as claimed in claim 2, wherein said first and second regulator elements comprise respectively first and second transistor elements having first and second load current conduction paths connected between said output node and said supply rail and first and second control electrodes for controlling the impedance of said first and second load current conduction paths respectively, said additional current-carrying path being arranged to carry supplementary current for said first control electrode when activated, so as to accelerate said transition from said first operational mode to said second operational mode.

14. A voltage regulator as claimed in claim 3, wherein said first and second regulator elements comprise respectively first and second transistor elements having first and second load current conduction paths connected between said output node and said supply rail and first and second control electrodes for controlling the impedance of said first and second load current conduction paths respectively, said additional current-carrying path being arranged to carry supplementary current for said first control electrode when activated, so as to accelerate said transition from said first operational mode to said second operational mode.

15. A voltage regulator as claimed in claim 4, wherein said first and second regulator elements comprise respectively first and second transistor elements having first and second load current conduction paths connected between said output node and said supply rail and first and second control electrodes for controlling the impedance of said first and second load current conduction paths respectively, said additional current-carrying path being arranged to carry supplementary current for said first control electrode when activated, so as to accelerate said transition from said first operational mode to said second operational mode.

16. A voltage regulator as claimed in claim 5, wherein said first and second regulator elements comprise respectively first and second transistor elements having first and second load current conduction paths connected between said output node and said supply rail and first and second control electrodes for controlling the impedance of said first and second load current conduction paths respectively, said additional current-carrying path being arranged to carry supplementary current for said first control electrode when activated, so as to accelerate said transition from said first operational mode to said second opera.

17. A voltage regulator comprising:

a first regulator element having a drain terminal connected to an output node, and a source terminal connected to a supply rail to supply load current to a load connected to the output node;

a second regulator element having a drain terminal connected to the output node, and a source terminal the supply rail;

first and second control modules to control the first and second regulator elements respectively to maintain the output node at a regulated voltage in the presence of a variable impedance presented by the load to the output node, the second regulator element and the second control module having a smaller load current capacity and smaller leakage current than the first regulator element and the first control module;

a mode selector to de-activate the first regulator element and the first control module in a first operational mode in response to a load current being less than a threshold value, and to activate the first regulator element and the first control module in a second operational mode in response to a load current being greater than a threshold value; and an additional current-carrying path to provide a current through the first control module to decrease an amount of time to activate the first regulator element during a transition from the first operational mode to the second operational mode;

wherein the mode selector is arranged to de-activate the first regulator element and the first control module in a transition from the first operational mode to the second operational mode with a first delay, and to activate the first regulator element and the first control module in a transition from the second operational mode to the first operational mode with a second delay, wherein the first delay is longer than the second delay.

18. The voltage regulator of claim 17, wherein the mode selector is arranged to de-activate the additional current-carrying path in response to the first regulator element and the first control module being activated in the second operational mode.

19. A method comprising:

controlling, by first and second control modules, respective first and second regulator elements to maintain an output node at a regulated voltage in the presence of a variable impedance presented by a load to a output node, wherein the first and second regulator elements connected between the output node and a supply rail to supply load current to the load connected to the output node, wherein the second regulator element and the second control module have a smaller load current capacity and smaller leakage current than the first regulator element and the first control module;

de-activating, by a mode selector, the first regulator element and the first control module in a first operational mode in response to a load current being less than a threshold value;

activating, by the mode selector, the first regulator element and the first control module in a second operational mode in response to a load current being greater than a threshold value, wherein the mode selector is arranged to de-activate the first regulator element and the first control module in a transition from the first operational mode to the second operational mode with a first delay, and to activate the first regulator element and the first control module in a transition from the second operational mode to the first operational mode with a second delay, wherein the first delay is longer than the second delay; and providing, by an additional current-carrying path, a current through the first control module to decrease an amount of time to activate the first regulator element during a transition from the first operational mode to the second operational mode.

20. The method of claim 19, further comprising:

de-activating, by the mode selector, the additional current-carrying path in response to the first regulator element and the first control module being activated in the second operational mode.

* * * * *